United States Patent [19]

Drury

[11] Patent Number: 4,572,251

[45] Date of Patent: Feb. 25, 1986

[54] PNEUMATIC BAGGER RING

[75] Inventor: Geoffrey Drury, Canaan, Conn.

[73] Assignee: Agrownautics, Inc., Salisbury, Conn.

[21] Appl. No.: 563,376

[22] Filed: Dec. 20, 1983

[51] Int. Cl.[4] ..... B65B 1/04

[52] U.S. Cl. ..... 141/1; 141/114; 141/314; 141/391; 53/255; 53/261; 53/390; 248/97; 248/99

[58] Field of Search ..... 141/1-12, 141/67, 68, 114, 313-317, 390-392; 53/459, 469, 570, 255, 257, 261, 262, 390; 248/95, 97, 99

[56] References Cited

U.S. PATENT DOCUMENTS 3,822,524 7/1974 Jerpbak ..... 141/390

*Primary Examiner*—Houston S. Bell, Jr.
*Attorney, Agent, or Firm*—Kenyon & Kenyon

[57] ABSTRACT

An item is placed into a relatively close fitting pliant bag by first turning the bag inside out over a horizontal ring mounted over a work surface on at least one upright support leg. Desirably, at least half of the peripheral extent of the ring is unsupported to facilitate pulling the bag over the ring and to facilitate removal of the bagged item. The item is placed within the ring in contact with the interior surface of the bottom of the bag and then moved downward through the ring, pulling the open top of the bag up, over, and through the ring. This turns the bag right side out, with the item inside. The ring has circumferentially spaced openings on its upper surface leading to a hollow interior that communicates via a valve to a source of pressurized air. The valve is actuated, preferably by downward force on the ring, to supply a flow of air through the openings when the bag is being pulled down over and through the ring to reduce friction and adhesion between the exterior surface of the bag and the surface of the ring.

17 Claims, 5 Drawing Figures

PNEUMATIC BAGGER RING

BACKGROUND OF THE INVENTION

This invention relates to apparatus for filling bags and, more particularly, to apparatus for supporting a bag of plastic film or similar pliant material to permit insertion of an item or items, particularly fresh produce items, therein.

For shipping fresh produce to market it is desirable to package the items in transparent plastic bags to maintain cleanliness, preserve freshness, and minimize handling damage. Lettuce, particularly the looser, more delicate leaf varieties such as Boston, Bibb, Grand Rapids, and the like, as well as endive, spinach, and other leafy vegetables present a problem in bagging because the leaves tend to bruise when the plant is slid into the bag. Also, trying to slide a lettuce plant into a relatively close fitting pliant bag requires a great deal of dexterity and is time consuming. If a bag much larger than the plant is used, the plant tends to fall out during subsequent handling. From a marketing standpoint it is preferable to use a bag size which is substantially filled by the item enclosed, and from a cost standpoint a smaller bag is less expensive than a larger one.

Commercial bagging machinery, while well adapted for handling chopped or shredded leafy vegetables, is not suitable for bagging whole plants without damage. A simple device, in the form of a wooden ring supported on three dowel legs with the plane of the ring horizontal, has been found to be useful for hand packing of lettuce plants in plastic bags. A worker turns a bag inside out over the ring, places a lettuce plant on the exposed inner surface of the bottom of the bag, reaches underneath the ring to grasp the outer surface of the bottom of the bag, and pulls the bag and the plant down through the ring, causing the bag to wrap itself around the plant.

Use of such a bagger ring is a help in hand-bagging lettuce plants, but the operation is slowed by sliding friction encountered between the bag and the ring as the bag is pulled down through the ring, and by adhesion of the bag to the ring if moisture is present on either the ring or the outside of the bag.

SUMMARY OF THE INVENTION

Accordingly, it is a primary object of the present invention to provide a bagger ring apparatus for use in placing an item inside a plastic bag, wherein the apparatus produces negligible frictional restraint to sliding of the bag over the ring, regardless of moisture on either surface.

It is a further object of the invention to provide a method for placing an item into a pliant bag by everting the bag over a horizontally disposed hollow ring, placing an item on the exposed inner surface of the bottom of the bag, and drawing the item and bag down through the ring, wherein a flow of air is delivered through holes in the upper surface of the ring from the hollow interior thereof to reduce friction and adhesion between the bag and the ring.

These and other objects are achieved by apparatus comprising a base member, a ring member having an outer circumference which is less than the peripheral length of an opening of a bag of predetermined size to be filled by use of said apparatus and an inner opening large enough to permit passage of an item to be placed in such a bag, and at least one upright support member having a lower end attached to the base member and an upper end attached to the ring member.

The ring member is hollow and has a plurality of small openings spaced circumferentially on its upper surface, the openings communicating with the hollow interior of the ring. Means are provided for connecting the hollow interior of the ring, preferably via a passage in the upright support member, to a source of air under pressure via a valve having an actuator selectively operable to deliver pressurized air to the interior of the ring when a bag is pulled over the ring.

Preferably the valve actuator is responsive to downward force exerted on the ring, so that air under pressure is supplied to the ring automatically whenever a predetermined threshold downward force on the ring is exceeded. The value of this threshold force should be low enough to actuate the valve to supply the air whenever perceptible friction develops between the bag and the ring, but it should not be so low that an excessive amount of air is used during each bagging operation, or that air is used between bagging cycles due to non-positive shutoff of the valve.

The method of the invention comprises generally:

(a) contacting an exterior surface portion of a pliant open-top bag against a vertically-supported generally horizontal hollow ring, the ring having an upper surface with a plurality of circumferentially spaced openings communicating with the hollow interior thereof and the outer circumference of the ring being less than the peripheral length of the open top edge of the bag;

(b) moving the open top of the bag toward and over the ring such that the edge of the open top passes by and exposes the interior surface of the contacted portion of the bag;

(c) pulling the open top of the bag downward around the ring so that the bag is turned inside out over the ring;

(d) placing an item within the ring in contact with the exposed inner surface of the bottom of the bag;

(e) moving the item down through the ring in contact with the inner surface of the bottom of the bag to draw the top of the bag up, over, and through the ring, thereby turning the bag right side out with the item inside; and (f) supplying a flow of air from the hollow interior of the ring through said spaced openings during steps (c) and (e) to decrease friction and/or adhesion between the exterior surface of the bag and the upper surface of the ring.

Further features and advantages of the invention will become apparent from the following description of the preferred embodiments, in connection with the attached drawings.

BRIEF DESCRIPTION OF THE DRAWINGS

FIG. 3 is an elevation view, slightly enlarged and partly in section, of the apparatus of FIG. 1 with a pliant bag everted over the ring.

DESCRIPTION OF THE PREFERRED EMBODIMENT

Figure 1:
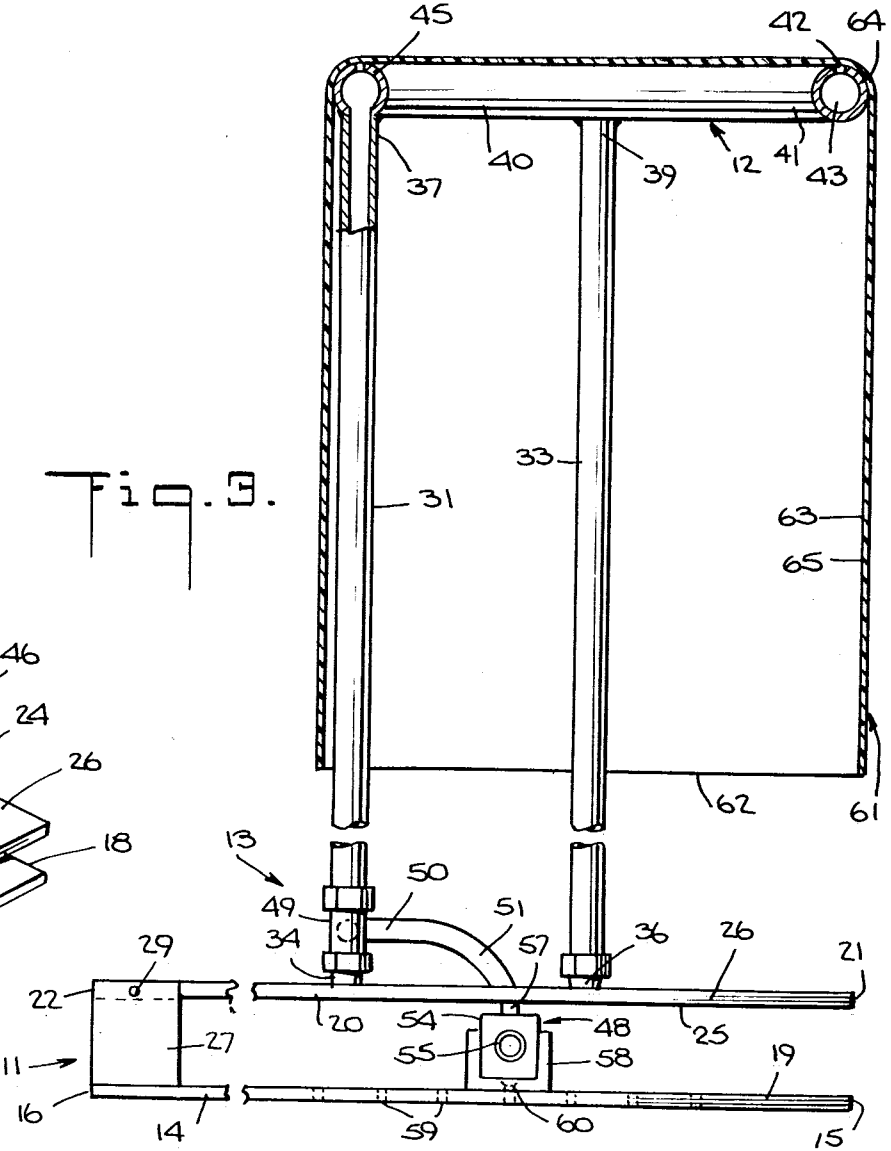
FIG. 1 is a perspective view, partly broken away, of a bagger ring apparatus according to the present invention.
Figure 1:
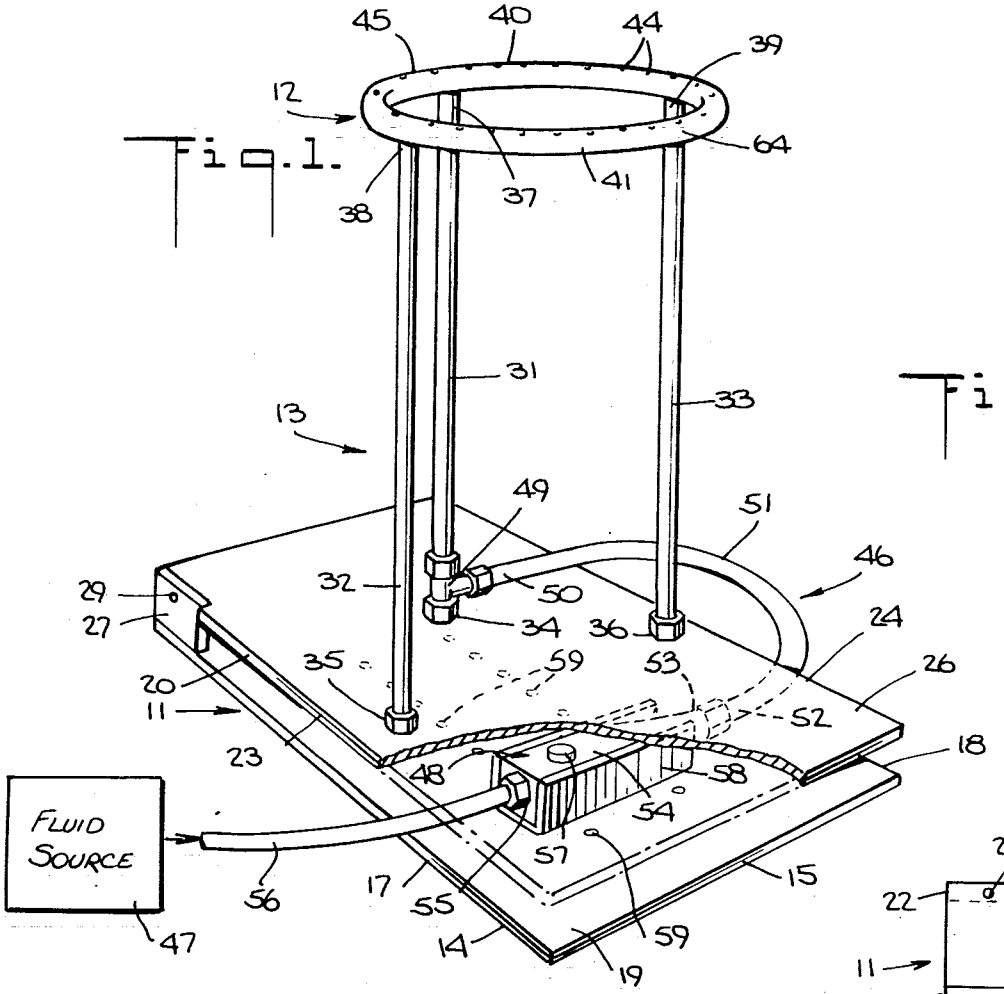

With reference to the figures, a bag filling apparatus according to the present invention includes a base 11, a ring member 12, and means 13 for supporting the ring member in spaced relation above the base. The base 11 includes an oblong flat plate 14 having a front edge 15, a rear edge 16, side edges 17, 18, and an upper surface 19.

The support means includes a flat support plate 20 having a front edge 21, a rear edge 22, side edges 23, 24, an under surface 25, and an upper surface 26.

The support plate 20 is hingedly connected to the base plate 14 by means such as upright tabs or ears 27, 28, which are welded or otherwise secured to the corresponding side edges 17, 18 of the base plate adjacent to the rear edge, and hinge pins 29, 30 installed through holes in the respective tabs into blind holes drilled into side edges 23, 24 of the support plate.

Ring member 12 is supported above support plate 20 on upright legs 31, 32, and 33. The respective lower ends 34, 35, and 36 of the support legs 31, 32 and 33 are firmly secured to the upper surface of the support plate, and the respective upper ends 37, 38, and 39 are rigidly connected to a segment 40 of the ring member 12 extending from the attachment point 38 of leg 32 to the attachment point 39 of leg 33.

Although three support legs are shown in the illustrated embodiment, two or even only one support leg may be used, so long as the ring member is supported rigidly. It is desirable that the supported segment 40 of the ring subtend an arc of no more than 180°, leaving an unsupported and unobstructed cantilevered portion 41 of the ring which includes at least half of the ring member. As will be explained below, the cantilevered portion of the ring facilitates both the placement of a bag on the ring member for receiving an item and the removal of the item in the bag from the apparatus.

An important feature of the present invention is that the ring member 12 is hollow, and a plurality of circumferentially spaced ports 42 extend from an interior passage 43 to openings 44 in a smooth upper surface 45 of the ring member. The hollow interior of the ring member also is in communication with a conduit 46 which connects to a source of fluid 47, such as air under pressure, through a valve device 48.

Conduit 46 includes the support leg 31, which is a hollow tube, the upper end 37 of which opens into the interior passage 43 of the ring member (see FIGS. 3 and 4) and the lower end of which is sealed. Near the lower end of leg 31 a T-fitting 49 is inserted. One end 50 of a flexible hose 51 is coupled to the stem of the T, and the other end 52 of the hose is coupled to an outlet port 53 at one end of a housing 54 of the valve device 48. An inlet port 55 at the other end of the valve housing is coupled through a hose 56 to the source 47.

The valve device 48 may be any type of commercially available valve having a quick-acting actuator. The valve of the illustrated embodiment is a standard valve for "shop air" hoses, of the type having a push button actuator 57 in the top of the housing. The valve device is mounted on the upper surface of the base plate 14 by means of a cradle 58 formed from a short length of 1 inch channel stock and fastened to drilled and tapped holes 59 in the base plate by machine screws 60. Preferably, several sets of holes 59 are provided at spaced intervals from the rear edge of the base plate to permit adjusting the distance of the valve actuator from the hinge axis.

The valve is mounted with the actuator facing up, so that it is contacted by the under surface 25 of the support plate 20. Thus, downward movement of the support plate will depress actuator 57, thereby opening the valve and allowing air to flow from the source 47 through conduit 46 to the hollow interior of ring member 12 and out through openings 44 in the upper surface of the ring member.

The operation of the above-described bagger ring apparatus will next be described in connection with placing an item, such as a head of lettuce, into a pliant bag, such as a plastic film bag.

With reference to FIG. 3, a pliant plastic film bag 61 is first placed inside-out over the ring member. This may be accomplished by holding the bag at opposite parts of the edge 62 of its open end with both hands, the open end facing away from the ring, and bringing the exterior surface 63 of the bag into contact with the ring. Preferably, the initially contacting part of the bag is in the vicinity of the closed end, and the initially contacted part of the ring is the central portion 64 of the unobstructed cantilevered part of the ring. The open end of the bag is then moved past the protruding cantilevered part of the ring while at the same time turning the edge inside out, so that the interior surface 65 of the bag is exposed. Finally, the open end of the bag is pulled over the supported segment 40 of the ring and down so that the bag is turned inside out over the ring, as shown in FIG. 3. Alternatively, it may be convenient to place the bottom end of the bag within the ring and then to turn down the edge of the open top around the ring, again starting by contacting the cantilevered portion of the ring first and moving the edge of the open top past the contacted portion before pulling down the rest of the top edge.

Figures 2, 4, 5:
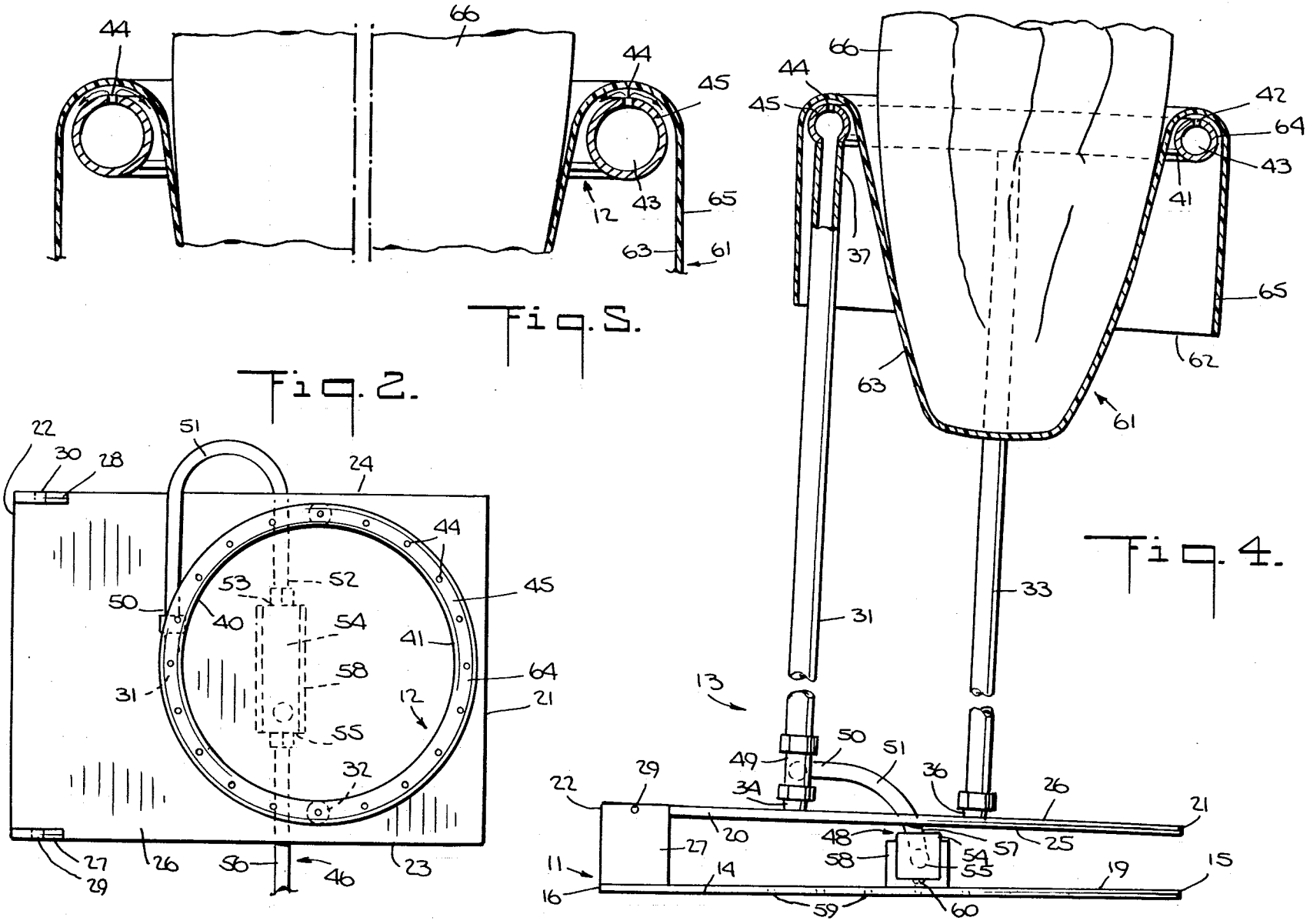
FIG. 2 is a plan view of the apparatus of FIG. 1.
FIG. 4 is an elevation view similar to FIG. 3, with a head of lettuce placed in the bag and partially inserted through the ring.
FIG. 5 is a partial view in section, at an enlarged scale, corresponding to the view of FIG. 4.

Referring next to FIG. 4, an item such as a lettuce plant 66 is placed into contact with the exposed inner surface 65 of the inside-out bag within the ring member 12. The item is grasped from below through the bag and pulled down through the ring, thereby pulling the open edge 62 of the bag up, over, and through the ring member. The bagged item is then easily removed under the unobstructed portion 41 of the ring member for placement in a suitable container (not shown).

From the foregoing description it is clear that the bagger ring permits rapid placement of lettuce and other delicate or perishable items in pliant bags, such as bags made of transparent plastic material, such as polyethylene or polypropylene. The item is placed within the bag without any sliding contact between the outer surface of the item and the inner surface of the bag. By placing the item within the original inner surface of the bag, the method also avoids any contamination from the outside surface of the bag and assures that any imprinted matter previously placed on the outer surface of the bag will be exposed again when the bag is filled.

Although the bagger ring eliminates sliding contact between the packaged item and the interior surface of the bag, there is sliding contact between the exterior surface of the bag and the ring. The resulting friction or adhesion, particularly when the ring becomes wet during packaging of lettuce or other fresh produce, significantly reduces the packaging rate by slowing placement and removal of the bags onto and from the ring. The present invention essentially eliminates this friction by supplying a flow of air through the openings in the upper surface of the ring whenever friction of the exterior surface of the bag sliding over the upper surface of the ring results in a downward force on the ring sufficient to depress the valve actuator (see FIG. 4). As shown in FIG. 5, the flow of air through the ports lifts the surface of the bag out of contact with the surface of the ring, completely eliminating sticking and tugging.

The amount of downward force on the ring necessary to actuate the air supply valve can be varied by adjusting the distance of the cradle 58 from the rear edge of the base plate, as indicated previously. This adjustment varies the length of the lever arm from the axis of hinge pins 29, 30 to the contact point of the support plate with the valve actuator button relative to the length of the effective lever arm between a downward force exerted on the ring member and the hinge axis. Thus, moving the cradle closer to the rear edge of the base plate reduces the downward force on the ring member necessary to actuate the valve against a given bias force urging the actuator button upward.

It will be apparent to those skilled in the art that modifications in the structure and arrangement of the disclosed apparatus and method can be made within the scope of the invention as it is described and claimed. For example, the valve device could be positioned for selective actuation by the packer instead of automatically upon the application of downward force on the ring member. This could be accomplished by a foot actuated or knee actuated valve to leave the hands free for the bagging operation. Automatic actuation is preferred, however, because air is supplied only when needed, without any conscious action by the operator.

I claim:

1. Apparatus for use in placing an item in a pliant tubular bag having an open end and a closed end, the apparatus including a base, a ring member having an outer circumference smaller than the circumference of the tubular bag and an internal opening large enough to pass the item and means connected to the base and attached to the ring member for supporting the ring member in a generally horizontal position and in spaced relation to the base, wherein the improvement comprises:

the ring member has a circumferential internal passage and a plurality of circumferentially spaced ports extending between said internal passage and an upwardfacing exterior surface of the ring member; and the apparatus further comprises a conduit having an outlet end connected to the internal passage in the ring member and an inlet end adapted to be connected to a source of fluid under pressure and means for selectively controlling a flow of fluid from the source through the conduit to the internal passage of the ring member and thence outwardly through the circumferentially spaced ports to facilitate pushing the item enclosed in the bag downward through the internal opening of the ring after the bag has been everted over the ring.

2. Apparatus according to claim 1 wherein said control means is responsive to force applied to the ring member to permit fluid flow through the conduit and circumferentially spaced ports only if a predetermined minimum force is applied to the ring member.

3. Apparatus according to claim 2 wherein the means for supporting the ring member is connected for movement relative to the base from a first position when no force is applied to the ring member to a second position when at least said predetermined minimum force is applied to the ring member, and the means for supporting the ring member comprises means for preventing flow through the conduit to the ring member when the means for supporting the ring member is in said first position and for permitting flow through the conduit to the ring member when the means for supporting the ring member is in the second position.

4. Apparatus according to claim 3 wherein said means for controlling a flow of fluid comprises a valve in said conduit, the valve having an actuator responsive to relative movement of the means for supporting the ring member with respect to the base, the actuator maintaining the valve shut when the means for supporting the ring member is in said first position relative to the base and opening the valve when the means for supporting the ring member is in said second position relative to the base.

5. Apparatus according to claim 1 wherein the means for supporting the ring member is hingedly connected to the base, and the means for controlling a flow of fluid comprises a valve in said conduit, the valve being positioned between the means for supporting the ring member and the base and having a push button actuator, the actuator being pressed to open the valve by movement of the means for supporting the ring member toward the base.

6. Apparatus according to claim 1 wherein the base comprises a flat plate, and the means for supporting the ring member maintains the ring member substantially parallel to said plate and includes a hollow leg that comprises part of said conduit.

7. Apparatus for use in placing an item in a pliant tubular bag having an open end and a closed end, the apparatus comprising:

a stationary horizontal base; support means connected to the base member, the support means including a hollow upright leg having a lower end and an upper end;

a hollow ring member attached to the upper end of the hollow upright leg and maintained substantially horizontal by the support means in spaced relation above the base, the ring member having an outer circumference smaller than the circumference of the tubular bag, an internal opening large enough to pass the item, a smooth upper surface, and a plurality of circumferentially spaced ports extending between the hollow interior and said upper surface of the ring member;

a conduit including said hollow upright leg, the conduit having an inlet end connected to a source of fluid under pressure and communicating with the hollow interior of the ring member; and a normally closed valve device disposed in said conduit, said valve device having an actuator that is selectively actuatable for opening the valve for delivering fluid to the hollow ring member and thence outwardly through the circumferentially spaced ports to facilitate pushing the item enclosed in the bag downward through the internal opening of the ring after the bag has been everted over the ring.

8. Apparatus according to claim 7 wherein:

said support means further comprises a flat plate, a hinge connection joining the flat plate to said horizontal base for rotation about a horizontal axis, and the lower end of said hollow upright leg being attached to said plate;

said valve device comprises a valve housing, the actuator of the valve device being movable with respect to the housing between a valve-shut position and a valve-open position, and means for biasing the valve actuator toward the valve shut position; and said apparatus further comprises means for mounting the valve housing on said base with the plate of the support means in contact with the valve actuator at a location spaced from the hinge connection of the plate with the base such that downward movement of said plate toward the base about the hinge connection will move the valve actuator toward the valve open-position against the force of the biasing means.

9. Apparatus according to claim 8 wherein means for mounting the valve housing on the base comprises means for adjusting the spacing of the valve actuator from said hinge connection.

10. Apparatus according to claim 8 wherein said conduit further comprises a T-connection inserted into the conduit adjacent to the lower end of said hollow upright leg and a flexible house connecting the valve device to the T-connection.

11. Apparatus according to claim 7 wherein the support means comprises two upright legs in addition to said hollow upright leg, the upper ends of the three legs being attached to the center and each end, respectively, of a segment of the ring member that subtends an angle of not more than 180 degrees.

12. Apparatus for use in inserting an item in a tubular pliant film bag having an open end and a closed end, the apparatus comprising:

a flat oblong base plate having front and rear edges, two side edges longer than the front and rear edges, and a top surface;

a flat support plate having a rear edge parallel to and spaced from the rear edge of the base plate, a top surface and an under surface;

means for connecting the flat support plate to the base plate for pivotal movement about a hinge axis parallel to the rear edge of the base plate;

three support legs, each leg having a lower end attached to the upper surface of the flat support plate and an upper end, one of the legs having a hollow interior communicating with the internal passage of the ring member;

a ring member attached to the upper ends of the three support legs in spaced relation to the upper surface of the support plate and having a smooth upper surface, an internal passage, and a plurality of circumferentially spaced ports extending between the internal passage and the smooth upper surface, the ring member having an outer circumference smaller than the peripheral length of the open end of the bag and an inner opening large enough to pass said item;

a valve device having a housing with an inlet port adapted to be connected to a source of fluid under pressure, an outlet port, an actuator having a contact surface movable toward the housing against a biasing force from a first valve-shut position to a second valve-open position;

means for mounting the valve selectively at one of a plurality of positions on the upper surface of the base plate, said positions being at predetermined different distances from the rear edge of the base plate, such that the actuator is contacted by the under surface of the support plate at a location spaced from the hinge axis, the actuator being movable toward said second valve-open position in response to rotation of the support plate about the hinge axis toward the upper surface of the base plate; and a flexible hose connecting the outlet port of the valve housing to the hollow interior of said one leg, such that fluid from the source will be delivered via said valve, when in the valve-open position, through the circumferentially spaced ports to facilitate pushing the item enclosed in the bag downward through the internal opening of the ring after the bag has been everted over the ring.

13. A method for placing an item into a pliant bag, the method comprising, in sequence:

(a) contacting an exterior surface portion of a pliant open-top bag against a vertically supported substantially horizontal hollow ring, the ring having an upper surface with a plurality of circumferentially spaced openings communicating with the hollow interior thereof and the outer circumference of the ring being less than the peripheral length of the open top of the bag;

(b) moving the open top of the bag toward and over the ring such that the edge of the open top passes by and exposes the interior surface of the contacted portion of the bag;

(c) pulling the open top of the bag downward around the ring so that the bag is turned inside out over the ring;

(d) placing an item within the ring in contact with the exposed inner surface of the bottom of the bag;

(e) moving the item downward through the ring in contact with the inner surface of the bottom of the bag to draw the top of the bag up, over, and through the ring, thereby turning the bag right side out with the item inside; and (f) supplying a flow of air from the hollow interior of the ring through said spaced openings during step (e) to decrease friction and adhesion between the exterior surface of the bag and the upper surface of the ring.

14. A method according to claim 13 wherein step (f) comprises supplying said flow of air in response to a downward force exerted on the ring.

15. The method of claim 13 wherein the bag is made of a plastic material.

16. The method of claim 15, wherein the item comprises a fresh produce food item.

17. The method of claim 16, wherein the item comprises lettuce.

* * * * *